United States Patent [19]

Ortolano

[11] Patent Number: 4,730,984

[45] Date of Patent: Mar. 15, 1988

[54] BLADED ROTOR STRUCTURE HAVING BIFURCATED BLADE ROOTS

[76] Inventor: Ralph J. Ortolano, 3776 Coolheights Dr., Rancho Palos Verdes, Calif. 90274

[21] Appl. No.: 904,363

[22] Filed: Sep. 8, 1986

[51] Int. Cl.[4] ..... F01D 5/32

[52] U.S. Cl. ..... 416/222; 416/217

[58] Field of Search ..... 416/222, 216, 217

[56] References Cited

U.S. PATENT DOCUMENTS

| | | | |
|---|---|---|---|
| 819,106 | 5/1906 | Wilkinson | 416/222 X |
| 2,315,616 | 4/1943 | Hall | 416/217 |
| 2,386,527 | 10/1945 | Wiberg | 416/216 |
| 2,857,132 | 10/1958 | McDowell | 416/222 X |
| 2,916,257 | 12/1959 | Poellmitz et al. | 416/222 X |
| 3,282,561 | 11/1966 | Frankel et al. | 416/216 |
| 3,584,971 | 6/1971 | Ortolano | 416/218 |
| 3,826,592 | 7/1974 | Raboin | 416/222 |

FOREIGN PATENT DOCUMENTS

| | | | |
|---|---|---|---|
| 65205 | 5/1979 | Japan | 416/222 |
| 39905 | 3/1984 | Japan | 416/222 |
| 240804 | 11/1985 | Japan | 416/222 |
| 875412 | 8/1961 | United Kingdom | 416/222 |

*Primary Examiner*—Everette A. Powell, Jr.
*Attorney, Agent, or Firm*—Sheldon & Mak

[57] ABSTRACT

An axial flow rotor disc apparatus of the radial blade entry type wherein bifurcated roots of the blades engage opposite sides of a circumferential rib member of the disc has shims or root liners between at least some of the blades for adjusting the blade spacing to match the circumference of the disc. The root liners are split into pairs for separate insertion from opposite sides of the rib member at convenient locations around the periphery of the disc, without requiring insertion at an entry slot for the blades. In one version of the apparatus, the liners are retained against the rib member by deforming corners of the roots circumferentially over the liners. In another version, the liners have dogs that engage cavities in the adjacent root. The liners can also be joined along an interlocking split line for holding each pair together.

20 Claims, 6 Drawing Figures

BLADED ROTOR STRUCTURE HAVING BIFURCATED BLADE ROOTS

BACKGROUND

The present invention relates to turbine and compressor rotors having radial blade entry construction, and more particularly to rotors having circumferentially bifurcated blade roots.

In radial blade entry construction, the blades of an axial flow turbine or compressor rotor are assembled by radial positioning onto the rotor disc at an entry gap of a peripheral retainer member of the disc, then moved circumferentially around the disc to respective operating positions. In one form of such construction, the retaining feature is a peripheral groove having a T-shaped cross-section for engaging corresponding T-shaped roots of the blades. As described in U.S. Pat. No. 3,584,971 to the present inventor and incorporated herein by reference, it is desirable to include in the rotor structure one or more thin liner members interposed between blade roots in adjacent groups of the blades. In this form of the construction, the root liners are T-shaped, being retained in the groove analogously to the blades, except that the liners do not have counterparts of the platform portions of the roots that typically interlock with the disc for preventing lateral separation of opposite sides of the groove. The Tee-type liner can be installed from the notch or entry gap; however, by moving adjacent blades temporarily apart and because the platform portion of the root shape has been omitted, it is possible to install these liners at convenient locations around the periphery of the wheel by first orienting the liner in the plane of the disc so that it can be lowered into the groove. The liner is then rotated crosswise in the groove and the blades brought together against opposite sides of the liner.

In another and desirable form of the radial blade entry construction, the blade roots are bifurcated, the retaining feature being a flanged ring that is gripped on opposite sides by opposing legs of the blade roots. These circumferential bifurcated roots are variously called "outside," "straddle," "claw," or "dovetail" roots. A problem with this construction is that a liner or shim comforming to the bifurcated shape of the roots can only be installed at the notch or entry gap. This greatly complicates accurate measurement of the required shim thickness and requires the liners to be moved from the gap around the periphery of the disc to where they are needed, which is time-consuming and can cause liner distortion due to close clearances between the liners and the groove.

A recent development is that problems relating to corrosion in steam turbines have led to the evaluation and use of corrosion-resistant surface protection or coating systems. Corrosion attacks all surfaces of the blade, including the root. The root is a highly stressed part of the blade, being required to carry centrifugal direct, bending, shear and bearing stresses, as well as steam bending and associated vibratory stresses. The root is also a location where numerous stress concentrations occur. Corrosion pitting and corrodent buildup and expansion have been known to be so severe that the blades could only be removed for maintenance by machining them out. A corrosion-resistant coating system, using diffusion alloying or electroplating, for example, are an attractive means for avoiding corrosion attack; however, the coatings introduce dimensional variations such that it is extremely difficult or virtually impossible to assemble the blades without trimming off some of the coating and base metal of one or more of the roots unless root liners are used. Aside from the extra labor involved, the trimming of coated roots largely defeats the benefit of a surface protection system.

Thus there is a need for a bladed rotor structure incorporating bifurcated blade roots wherein groups of the blades are separated by a thin liner member interposed between adjacent blade roots, the structure providing installation of liners at convenient locations around the periphery of the wheel without requiring the liners to be inserted at a notch or entry gap of the rotor disc.

SUMMARY

The present invention meets this need by providing a rotor disc apparatus incorporating two-piece root liners. The apparatus includes a rotor disc having circumferential rib attachment means, an annular array of outwardly extending blades that have root portions externally engaging opposite sides of the attachment means, at least one pair of liner members located on opposite sides of the attachment means between the root portions of adjacent blades, and means for retaining the liner members against the attachment means. In one version of the present invention, the retainer means includes a retainer member on the root portion of at least one of the blades adjacent to each liner member, the retainer member extending circumferentially from the root portion and over the liner member.

The attachment means can have an opening for radial entry of the root member onto the disc. A last blade extending into the opening has means for securing to the disc that is not a part of the present invention. An important advantage of the present invention is that the liner members do not have to be assembled to the disc at the opening. Thus the thickness of the liner members can be determined after some or all of the blades are engaging the attachment means, the root members being inserted at desired locations between the blades without having to move the blades to opposite sides of the opening.

The attachment means can include ledge members on each side. Typically, the ledge members are in hooked engagement with the root members. Preferably, the liner members also engage the ledge members for preventing radial movement of the liner members outwardly from the disc. Thus the retainer means can be advantageously oriented primarily for holding the root portions axially against the attachment means, because the retainer means is only required for axial restraint of the liner members.

Accordingly, the retainer members are preferably located at the sides of the root portions where access is easily provided. More preferably, the retainer members are located on portions of the root members that extend axially away from the attachment means beyond an outside contour of the retainer members. This advantageously facilitates forming the retainer members by permanent deformation of the root members. Herein the terms "axial" and "axially" refer to a direction that is perpendicular to a plane of rotation of the disc.

The retainer means can also include a joint formed along an interlocking split line between the liner members of a mating pair. The interlocking split line holds the tops of the liner members together such that the retainer member need only engage the liner member proximate the bottom thereof.

In another version of the present invention, the retainer means includes a dog portion of the liner member extending circumferentially into a retainer cavity of the adjacent root portion. The dog portion can be located proximate the bottom of the liner member, in cooperation with the interlocking split line that holds the liner members together.

The blades can be connected in arcuate groups at locations remote from the root portions for suppressing vibrations in the blades. The root portions of adjacent blades in each group can be in contact for defining the blade spacing within each group. Accordingly, the pairs of liner members are preferably located between the end blades of adjacent blade groups for ease of manufacture.

The apparatus of the present invention provides a convenient means compensating for manufacturing variations in the circumferential thickness of bifurcated blade roots in outside root axial flow rotor construction. This is particularly true in cases where it is necessary that the blade root be coated for corrosion resistance.

The present invention also provides a method for assembling an axial flow fluid rotor disc apparatus, the method including the steps of:

(a) selecting a rotor disc having circumferential rib attachment means;

(b) providing an annular array of blades for contacting the fluid, the each blade having a root portion for externally engaging opposite sides of the attachment means with the blade extending outwardly from the root portion, the root portions having an aggregate circumferential thickness of slightly less than an associated circumference of the disc;

(c) attaching the blades to the disc in engagement with the attachment means;

(d) inserting at least one pair of liner members between the root portions of adjacent blades on opposite sides of the attachment means for spacing apart the blades, thereby adjusting the aggregate circumferential thickness of the root portions to the disc circumference; and (e) permanently deforming the root portion of at least one of the blades against an outside edge of each of the liner members for forming a retainer member on the root portion, the retainer member extending circumferentially over a portion of the liner member for preventing movement of the liner member away from the attachment means.

Preferably the step of permanently deforming the root portion includes the steps of selecting a punch for an impact tool, directing the punch axially against the root portion proximate the respective liner members, operating the impact tool, and moving the punch radially along the root portion. Thus the liner members are quickly, easily, and effectively retained against centrifugal loading when the rotor disk apparatus is operated at high speed.

DRAWINGS

These and other features, aspects, and advantages of the present invention will become better understood with reference to the following description, appended claims, and accompanying drawings where:

DESCRIPTION

Figure 1:
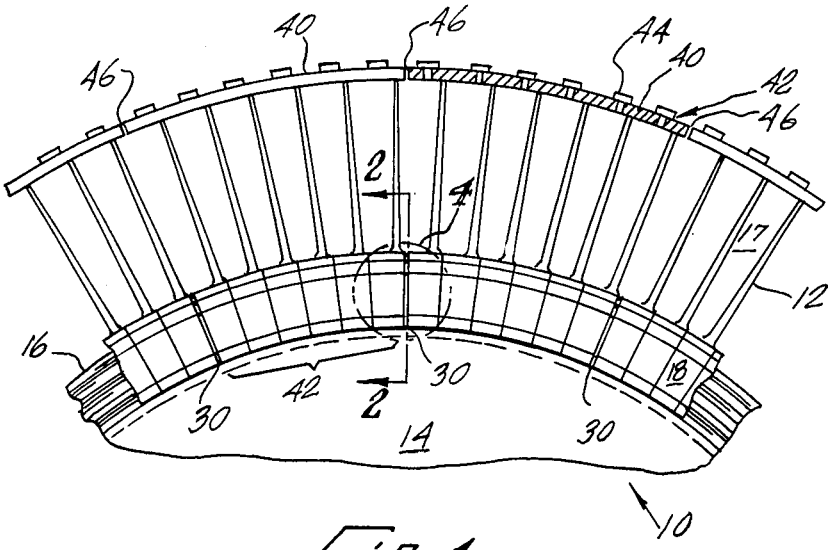
FIG. 1 is a fragmentary elevational view of an axial flow rotor disc apparatus according to the present invention.

The present invention is directed to an axial flow rotor disc apparatus incorporating two-piece root liners. With reference to the drawings, a rotor assembly 10 includes an array of blades 12 for coupling to a fluid in a turbine, compressor, or the like. A rotatable disc 14 of the rotor assembly 10 has a peripheral attachment rib 16 on which the blades 12 are mounted. Each blade 12 has a foil member 17 and a bifurcated root portion 18 that engages opposite sides of the rib 16. An annular series of ledges 20 on opposite sides of the rib 16 engage corresponding grooves 22 in respective root legs 23 of the root portions 18. The engagement of the ledges 20 in the grooves 22 prevents the blades 12 from leaving the disc 14 when the rotor assembly 10 is operated at a high speed of rotation.

In order to assemble the blades 12 to the disc 14, a gap or notch 24 is provided in the ribs 16 wherein the ledges 20 are absent. Thus the root portions 18 of the blades 12 can be sequentially lowered radially onto the ribs 16, then moved to a desired circumferential location along the ledges 20. When a full complement of the blades 12 is on the disc 14, a last blade (not shown) is located at the notch 24, means (not shown) being provided for securing the last blade to the disc 14. Any conventional securing means can be used, this not being a part of the present invention.

Figure 2:
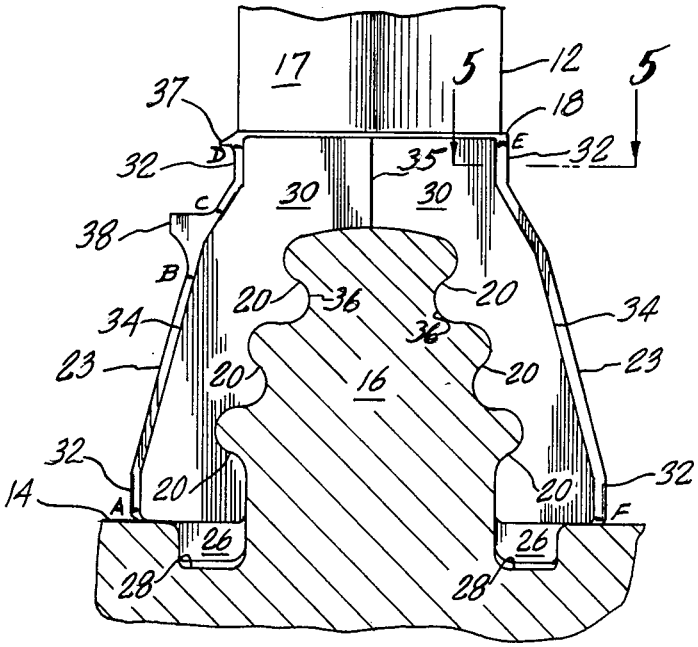
FIG. 2 is a fragmentary sectional elevational view of the apparatus of claim 1 on line 2—2 of FIG. 1.
Figure 4:
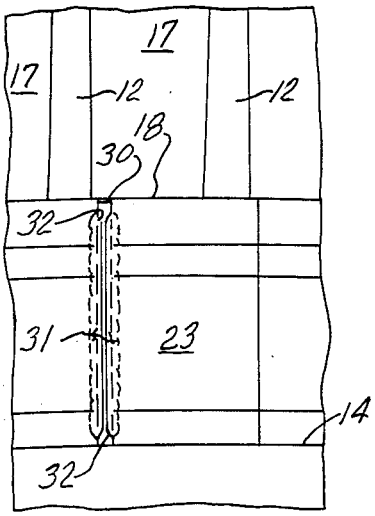
FIG. 4 is a detail view within region 4 of FIG. 1.
Figure 5:
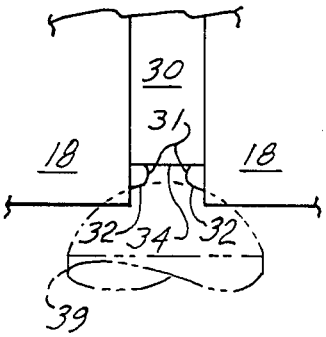
FIG. 5 is fragmentary plan view of the apparatus of FIG. 1 on line 5—5 of FIG. 2.
Figure 3:
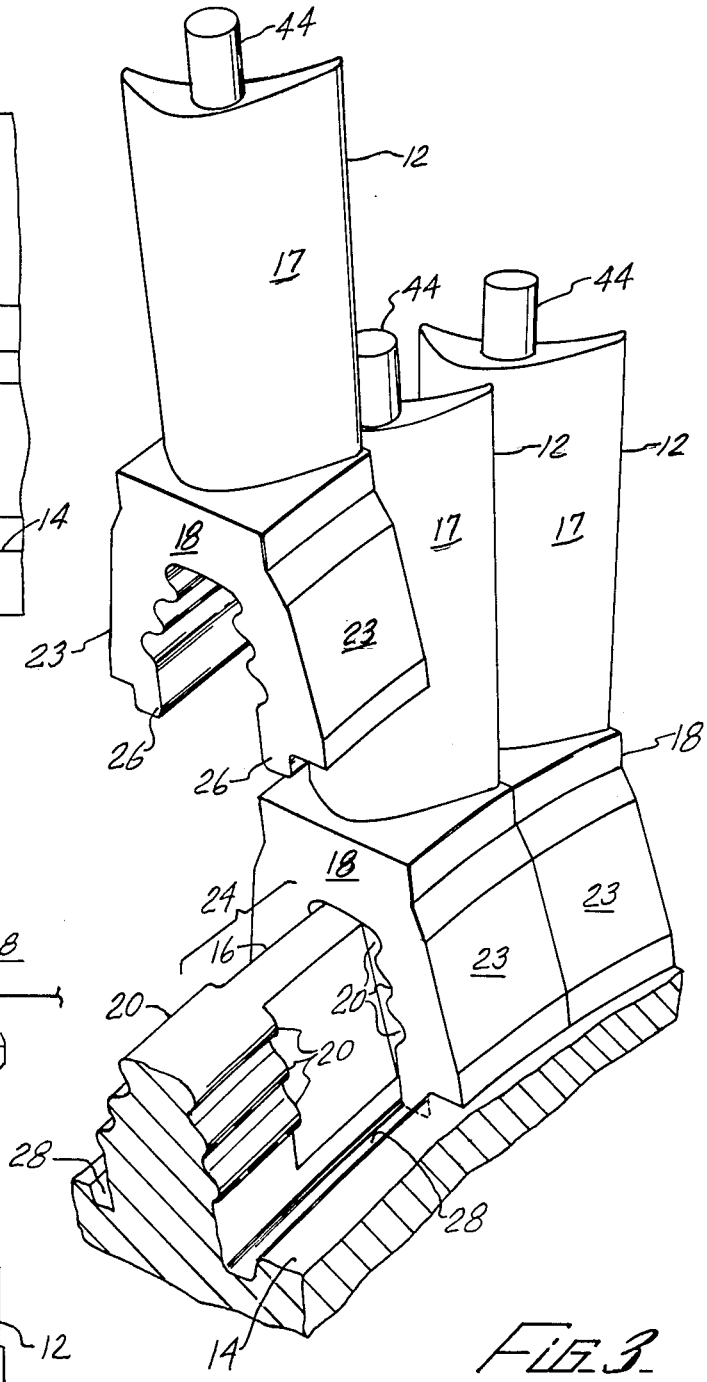
FIG. 3 is a fragmentary oblique elevational perspective view of the apparatus of FIG. 1.

In exemplary outside root construction, each root leg 23 includes a downwardly extending root lug 26, the root lugs 26 extending into corresponding lug grooves 28 of the disc 14 as shown in FIG. 2. The root lugs 26 prevent deflection of the root legs 23 axially away from opposite sides of the rib 16 under heavy centrifugal loading when the rotor assembly 10 is operated at high speed, but are unnecessary on the liner members 30 because of the absence of a foil member thereon.

Due to manufacturing tolerances, the root portions 18 of the blades 12 will have an aggregate circumference somewhat less than a corresponding circumference of the disc 14. According to the present invention, one or more pairs of liner members 30 are provided between the root portions 18 of adjacent blades 12 for adjusting a total circumferential thickness of the blades 12 and the liner members 30 up to the circumference of the disc 14. The present invention provides axial assembly of the liner members 30 from opposite sides of the rib 16 at convenient locations around the disc 14, the liner members 30 being held in place by retainer means 31 as described herein.

In one version of the present invention, the liner members 30, being confined circumferentially between the adjacent root portions 18, are also confined between the rib 16 and one or more retainer members 32. The retainer members 32 extend circumferentially over the liner members 30 from opposite sides of one or both of the adjacent root portions 18. As shown in FIG. 2, the liner members 30 are made undersize, having an outside edge 34 generally conforming to, but located inside the cross-sectional outline of the root portions 18, permitting the retainer members 32 to be formed by staking the corners of the root portions 18, permanently deforming local regions thereof against the outside edge 34.

In a preferred configuration, the liner members 30 are joined along a split line 35, having an inside edge 36 that engages the rib 16 for preventing movement of the liner members 30 radially outwardly from the disk 14. Thus the retainer members 32 can be formed at conveniently accessible locations at the sides of the root portions 18, the retainer members 32 holding the liner members 30 primarily axially toward opposite sides of the ribs 16. As also shown in FIG. 2, the root portion 18 may be contoured for reasons not relevant to the present invention, forming, for example, a lip 37 or a seal land 38, extending axially outwardly from the main part of the root portion 18. The retainer members 32 are located for avoiding interference with these features. Accordingly, the retainer members 32 are located within region A-B, between the bottom of the liner member 30 and the land 38, region C-D, between the land 38 and the lip 37, and region E-F, along an uninterrupted side of the root portion 18.

A convenient and effective method for forming the retainer members is by staking with a rounded punch 39 that is driven by a power impact hammer tool (not shown), The punch 39 is directed generally axially against the root portions 18 proximate the outside edge 34 of each liner member 30 and moved along each of the regions A-B, C-D, and E-F as the tool is operated for producing a semi-continuous permanent deformation along the respective regions. The punch 39 is advantageously guided during this operation by protruding slightly toward the liner member 30 between the adjacent root portions 18.

The liner members 30 do not have counterparts of the root lugs 26 that extend into the lug grooves 28. Thus the liner members 30 can be inserted axially between the root portions 18 of adjacent blades 12 toward opposite sides of the ribs 16, without having to be installed at the notch 24. Accordingly, some or all of the blades 12 can be assembled onto the disk 14 prior to determining the number and thickness of the liner members 30 to be inserted for effecting a snug closure of the blades 12 in the rotor assembly 12. It is not required to engage the liner members 30 with the rib 16 in sequence with the blades 12 or repositioning the blades 12 on opposite sides of the notch 24.

Figure 6:
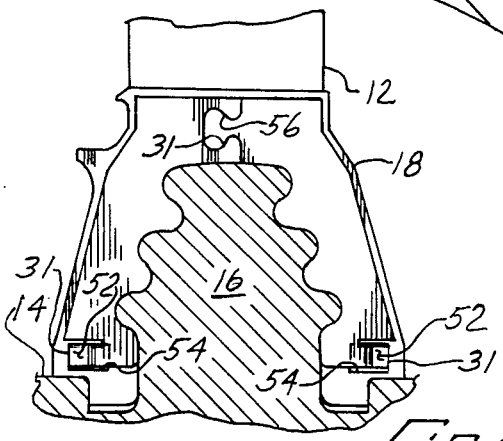
FIG. 6 is a fragmentary sectional elevational view as in FIG. 2 showing an alternative configuration of the apparatus of FIG. 1.

With reference to FIG. 6, another version of the present invention has the retainer means 31 including at least one lug 52 extending circumferentially from each liner member 30. The lug 52 engages a cavity 54 in the root portion 18. The lug 52 can be formed by bending a portion of the liner member 30. Alternatively, the lug 52 can be a pin (not shown) that protrudes the liner member 30.

As also shown in FIG. 6, the retainer means 31 can be augmented by joining the liner members 30 along an interlocking split line 56 that holds the tops of the liner members 30 together. Thus additional axial support for the liner members 30 is only required at the base of the rib 16, proximate the bottoms of the liner members 30.

The rotor assembly 10 includes a plurality of shroud members 40 for connecting the blades 12 at locations radially remote from the root portions 18, the shroud members 40 defining corresponding groups 42 of the blades 12. As shown in FIG. 1, the connection is accomplished by each blade 12 having a tenon 44 that protrudes the associated shroud member 40, this being only one of several suitable ways of connecting the blades 12 remotely from the root portions 18. The shroud members 40 function to prevent undesired vibrations of the blades 12 that would otherwise lead to premature failure of the rotor assembly. The blades 12 are connected to the shroud member 40 at uniform intervals based on a predetermined blade spacing or pitch corresponding to the circumferential thickness of the root portions 18. Thus adjacent blades 12 within each group have the root portions 18 in contact. The number of the blades 12 in each group 42 is typically predetermined for optimum vibratory suppression.

All of the circumferential clearance between the blades 12 can be taken up by a single pair of the liner members 30. However, it is preferred that there be an evenly distributed plurality of pairs of the liner members 30 for maintaining static and dynamic balance of the rotor assembly 12. Also, the pitch or spacing of the blades 12 should not depart substantially from a predetermined dimension corresponding to a design circumferential thickness of the root portions 18 for maintaining a high coupling efficiency. Accordingly, it is preferred that the liner members 30 be used between each of the groups 42, except that the liner members 30 are never used at the entry gap or notch 24. It is also preferred that the thickness of each pair of the liner members 30 approximate an average thickness required for closing the blades 12 in the rotor assembly 10.

An important advantage of the present invention is that larger manufacturing tolerances can be used for the circumferential thickness of the root portions 18 than would otherwise be practical. For example, some manufacturers hold a tolerance of $+0.0002/-0.0000$ on the thickness for limiting the need for trimming the root portions 18 at assembly. However, a tolerance of $+0.000/-0.002$ is practical when the root members 30 are used in the rotor assembly 10 according to the present invention. More importantly, corrosion-resistant coatings can now be used to advantage in outside root, radial blade insertion rotor construction. This is because the liner members 30 avoid the requirement that any of the root members 18 be trimmed, removing the protective coating and defeating the purpose of the coated construction. According to the present invention, no root material is removed, the liner members 30 being used to make up the required space. After the liner members 30 are installed and the complete row of blades 12 has been closed on the disk 14, the retainer members 32 are formed by staking outside corners of the root portions 18. It is acknowledged that in performing this operation, the coating on the outside corners on the root portion 18 is subject to being damaged. However, this location is not subject to cracking, being only moderately stressed; thus this result is of minor importance. Moreover, the damage is minimal when the staking is performed semi-continuously as described above.

A suitable material for the liner members 30 is AISI 304 corrosion-resistant steel. This material is relatively easy to fabricate and does not require a protective coating. Special high-strength materials as are used for the blades 12 are not required because the liner members 30 do not carry the centrifugal load of the foil members 17 or the shroud member 40. In applications where corrosion is not a critical factor, other materials can of course be used. The liner members 30 can be conveniently and inexpensively punched from sheet material or cut from shim stock.

As shown in FIG. 1, a group gap 46 is produced between the shroud members 40 of adjacent groups 42. The group gap 46 is increased by the presence of the liner members 30 between the groups 42, a condition that is not usually detrimental. Typically, a pair of the liner members 30 can be used between every three or four blades on most rows, provided that there is not partial arc excitation. The liner members 30 can also be used as needed between the blades 12 within the groups 42.

Although the present invention has been described in considerable detail with reference to certain preferred versions thereof, other versions are possible. For example, on first reaction stages or the first full admission impulse stages, where a cover member is formed integrally with each blade in place of the shroud member 40 and cover contact is important between each of the blades, coatings for corrosion resistance are ordinarily not used. However, by making approximately 10% of the blades with a cover overpitch and using matching liner members at these blades, they can be assembled with infrequent trimming at the cover and no trimming at the root. Thus this variation is also compatible with protective coatings; loss of coating at the cover is considered inconsequential. Moreover, the liner members 30 can be curved for fitting contoured or bucket-shaped roots. Typically, the liner members 30 can be relatively thin shim stock having a thickness in the range of 0.002 to 0.010 inches. In such thicknesses the liner members 30 can easily conform to the shape of contoured roots. Therefore, the spirit and scope of the appended claims should not necessarily be limited to the description of the preferred versions contained herein.

What is claimed is:

1. A rotor apparatus for axial flow coupling to a fluid, the apparatus comprising:

(a) a rotor disc having circumferential rib attachment means;

(b) an annular array of blades for contacting the fluid, the each blade having a root portion externally engaging opposite sides of the attachment means, the blade extending outwardly from the root portion, the root portions having an aggregate circumferential thickness of slightly less than an associated circumference of the disc;

(c) at least one pair of liner members, each pair of the liner members being located on opposite sides of the attachment means between the root portions of the adjacent blades for spacing apart the adjacent blades, thereby adjusting the aggregate circumferential thickness of the root portions to the disc circumference; and (d) means for retaining the liner members proximate the attachment means, comprising the root portion of at least one of the blades adjacent to each of the liner members being adapted for forming a retainer member extending circumferentially over a portion of the liner member for preventing movement of the liner member away from the attachment means.

2. The apparatus of claim 1 wherein the attachment means includes an opening for permitting entry of the root members radially onto the disc, a last blade extending into the opening and having means for securing to the disc.

3. The apparatus of claim 1 wherein the attachment means includes at least one ledge member on each side thereof and the liner members engage the ledge members for preventing movement of the liner members radially outwardly from the disc.

4. The apparatus of claim 3 wherein the retainer means comprises opposite liner members of a pair being joined along an interlocking split line between the liner members for axially retaining the liner members together.

5. The apparatus of claim 1 wherein the attachment means includes at least one ledge member on each side thereof and the liner members engage the ledge members for preventing movement of the liner members radially outwardly from the disc, and the root portions are adapted for forming at least a portion of the retainer members at the sides of the root portions of the blades.

6. The apparatus of claim 5 wherein each liner member has an outside contour portion that is displaced inwardly from the side of the associated root portion, the retainer members being integral with the root portion and engaging the inwardly displaced outside contour portion of the respective liner members.

7. The apparatus of claim 1 wherein the retainer members are formed in the root members by permanent deformation of the root members.

8. The apparatus of claim 1 wherein the retainer means comprises a dog member on at least some of the linear members, the dog member extending circumferentially into engagement with a cavity in the adjacent root portion.

9. The apparatus of claim 8 wherein the dog member is located proximate the bottom of the liner member, the retainer means further comprising an interlocking split line forming a joint connecting opposite liner members for axially retaining the liner members together.

10. The apparatus of claim 1 further comprising means for connecting the blades in arcuate groups of the blades at one or more locations remote from the root portions, the root portions of adjacent blades in each group being in contact, wherein the pairs of liner members are located between the blades of adjacent blade groups.

11. The apparatus of claim 1 wherein at least some of the root members are provided with a surface protection system coating, the liner members adjusting for variations in the thickness of the root members, including variations caused by the coating.

12. A rotor apparatus for axial flow coupling to a fluid, the apparatus comprising;

(a) a rotor disc having circumferential rib attachment means including at least one ledge member on each side thereof;

(b) an annular array of blades for contacting the fluid, each blade having a root portion externally engaging the ledge members on opposite sides of the attachment means, the blade extending outwardly from the root portion, the root portions having an aggregate circumferential thickness of slightly less than an associated circumference of the disc;

(c) at least one pair of liner members, each pair of the liner members being located on opposite sides of the attachment means between the root portions of adjacent blades for spacing apart the adjacent blades, thereby adjusting the aggregate circumferential thickness of the root portions to suit the disc circumference, the liner members engaging the ledge members for preventing movement of the liner members radially outwardly from the disc, the liner members extending axially away from the attachment means to an outside contour portion that is inwardly displaced from the sides of the root portions; and (d) the root portion of at least one of the blades adjacent to each of the liner members being adapted for forming a retainer member extending circumferentially over a portion of the liner member, at least a portion of the retainer member being located at one side of the root portion and engaging the outside of the liner member, for preventing movement of the liner member axially away from the attachment means.

13. A method for assembling an axial flow fluid rotor disc apparatus, the method comprising the steps of:

(a) selecting a rotor disc having circumferential rib attachment means;

(b) providing an annular array of blades for contacting the fluid, the each blade having a root portion for externally engaging opposite sides of the attachment means with the blade extending outwardly from the root portion, the root portions having an aggregate circumferential thickness of slightly less than an associated circumference of the disc;

(c) attaching the blades to the disc in engagement with the attachment means;

(d) inserting at least one pair of liner members between the root portions of adjacent blades on opposite sides of the attachment means for spacing apart the adjacent blades, thereby adjusting the aggregate circumferential thickness of the root portions to suit the disc circumference; and (d) permanently deforming the root portion of at least one of the blades adjacent to each of the liner members for forming a retainer member thereon, the retainer member extending circumferentially over a portion of the liner member for preventing movement of the liner member away from the attachment means.

14. The method of claim 13 wherein the step of permanently deforming the root portion comprises the steps of:

(a) selecting a punch for an impact tool;

(b) directing the punch axially against the root portion proximate the respective liner members;

(c) operating the impact tool; and (d) moving the punch radially along the root portion.

15. The method of claim 13 wherein the step of providing the annular array of blades includes providing as many of the blades as will fit on the rotor; and the step of inserting the liner members comprises the steps of selecting the liner members from a set of liner members having approximately equal thickness; and positioning pairs of the liner members approximately equally spaced about the rotor disk.

16. The method of claim 13 wherein the step of providing the annular array of blades includes providing as many of the blades as will fit on the rotor; the method further comprises the step of connecting the blades in arcuate groups of the blades at one or more locations remote from the root portions, the root portions of adjacent blades in each group being in contact; and the step of inserting the liner members comprises the steps of selecting the liner members from a set of liner members having approximately equal thickness; and positioning pairs of the liner members approximately equally spaced about the rotor disk between the blades of adjacent blade groups.

17. The apparatus of claim 6 wherein the outside contour of each liner member is entirely displaced inwardly from the side of the associated root portion.

18. The apparatus of claim 1 comprising a spaced plurality of pairs of the liner members, wherein the maximum thickness of each pair of the liner members is substantially less than the circumferential thickness of each root portion.

19. The apparatus of claim 18 wherein the total aggregate thickness of the pairs of liner members is less than approximately the circumferential thickness of the root portion of one blade, the pairs of liner members are approximately equal in circumferential thickness and evenly distributed about the rotor disc.

20. The apparatus of claim 17 wherein the pairs of liner members range in circumferential thickness from approximately 0.002 inch to approximately 0.010 inch.

* * * * *